US007820931B2

(12) United States Patent
Lee et al.

(10) Patent No.: US 7,820,931 B2
(45) Date of Patent: Oct. 26, 2010

(54) TRIGGER ARRANGEMENT WITH FEEDBACK RESPONSE

(75) Inventors: Roland Lee, Flushing, NY (US); Robert Spano, Smithtown, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 533 days.

(21) Appl. No.: 11/782,944

(22) Filed: Jul. 25, 2007

(65) Prior Publication Data

US 2009/0026054 A1 Jan. 29, 2009

(51) Int. Cl.
*H01H 9/00* (2006.01)

(52) U.S. Cl. ..... 200/522; 335/205

(58) Field of Classification Search ... 200/43.16–43.18, 200/61.85, 520, 522, 318, 318.1, 323, 329, 200/332.2, 1 V; 335/205–207; 173/170, 173/171, 217; 310/50; 338/176, 178
See application file for complete search history.

(56) References Cited

U.S. PATENT DOCUMENTS 3,873,957 A * 3/1975 Wurscher et al. ..... 338/32 H
5,523,730 A * 6/1996 Van Zeeland ..... 335/205
5,598,082 A * 1/1997 Gilpin et al. ..... 200/293.1
5,867,082 A * 2/1999 Van Zeeland ..... 335/205
6,443,675 B1 * 9/2002 Kopras et al. ..... 409/182
6,927,353 B2 * 8/2005 Bader et al. ..... 200/522
7,053,325 B2 * 5/2006 Yuasa et al. ..... 200/522
7,174,972 B2 * 2/2007 Kristen et al. ..... 173/171
7,211,758 B2 * 5/2007 Lui ..... 200/447
7,291,796 B2 * 11/2007 Liu et al. ..... 200/520
7,326,869 B2 * 2/2008 Flynn et al. ..... 200/341
7,431,103 B2 * 10/2008 Schell et al. ..... 173/170
2005/0025599 A1 * 2/2005 Kopras et al. ..... 409/182

* cited by examiner

*Primary Examiner*—Michael A Friedhofer

(57) ABSTRACT

A device includes a trigger arrangement activating a function of the device. The trigger arrangement includes a trigger mechanism movable between a first position and a second position. The device also includes a feedback mechanism exerting a force biasing the trigger mechanism to the first position. The feedback mechanism produces a tactile feedback response when the trigger mechanism is moved from the first position.

18 Claims, 1 Drawing Sheet

TRIGGER ARRANGEMENT WITH FEEDBACK RESPONSE

FIELD OF INVENTION

The present application generally relates to trigger arrangements for electronic devices.

BACKGROUND INFORMATION

Electronic devices often include trigger arrangements that are used to access a functionality thereof. Trigger arrangements include mechanical triggers such as keypad buttons, push buttons and gun-style triggers. In certain applications, it is desirable to include a feedback response in order to indicate that the trigger has been successfully engaged. For example, pressing a key may produce a "click" that can be felt by a user.

In some situations, space, cost or other constraints may render the use of a conventional feedback mechanism difficult or impracticable. Consequently, the trigger arrangement may not be able to provide the user with adequate feedback.

SUMMARY OF THE INVENTION

The present invention relates to a device which includes a trigger arrangement activating a function of the device. The trigger arrangement includes a trigger mechanism movable between a first position and a second position. The device also includes a feedback mechanism exerting a force biasing the trigger mechanism to the first position. The feedback mechanism produces a tactile feedback response when the trigger mechanism is moved from the first position.

DETAILED DESCRIPTION

Figure 1:
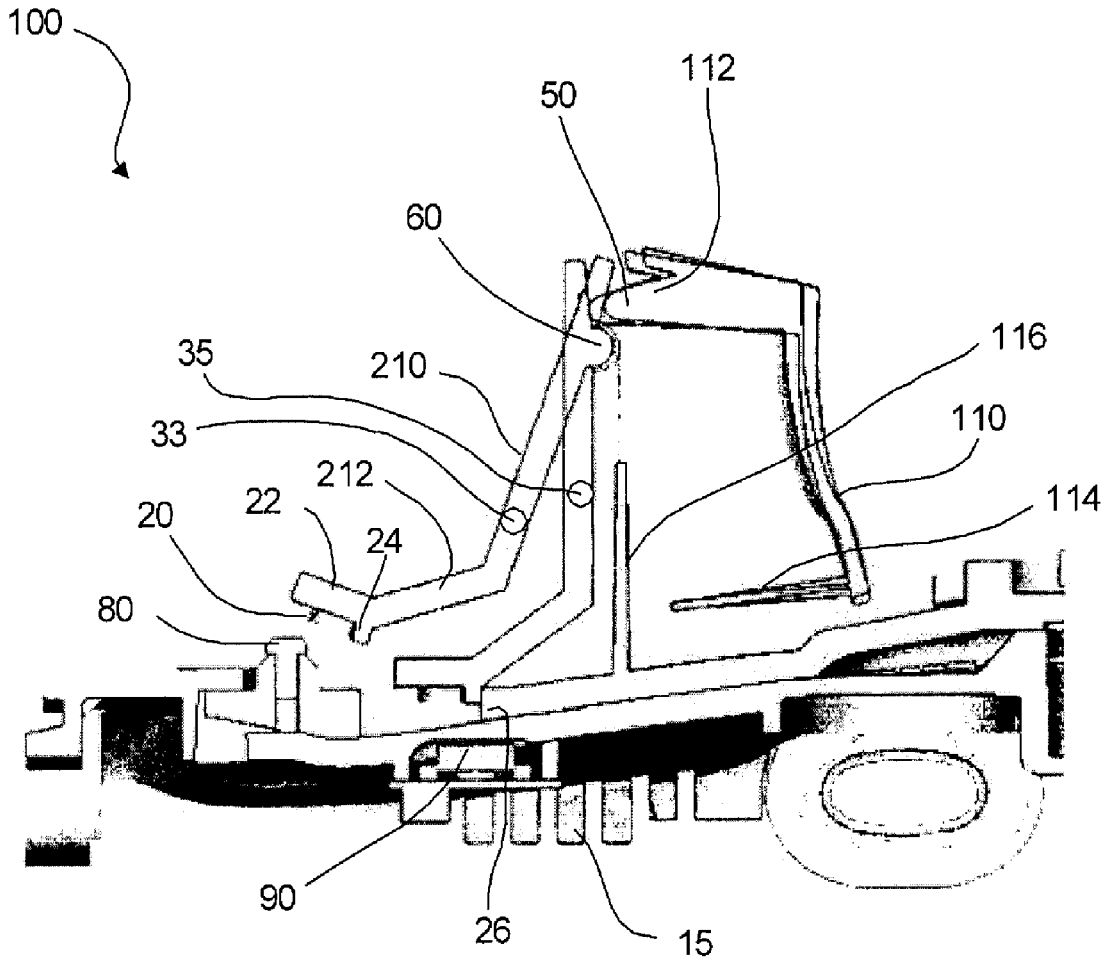
FIG. 1 shows a trigger arrangement according to the present invention.

The present invention may be further understood with reference to the following description and the appended drawings, wherein like elements are provided with the same reference numerals. The present invention relates to trigger arrangements with a feedback response. Various embodiments of the present invention will be described with reference to a trigger arrangement for a handheld device (e.g., a bar code scanner). However, those skilled in the art will understand that the present invention may also be implemented in any other device that requires a trigger arrangement. Thus, the present invention may be implemented in, for example, mobile computers, radio-frequency identification ("RFID") readers, cell phones, multimedia devices, automated teller machines, etc.

FIG. 1 shows an exemplary embodiment of a trigger arrangement 100 according to the present invention. The trigger arrangement 100 may be implemented in a handheld device such as a bar code scanner. For example, the trigger arrangement 100 may comprise a user-interfaceable portion of a detachable handle for the bar code scanner. The trigger arrangement 100 may include a gun-style trigger 110 that, when engaged by a user, enables a function of the handheld device. The trigger 110 may be formed of any substantially rigid material (e.g., plastic or metal) and may be shaped to conform to a curvature of a finger or multiple fingers. The trigger 110 may include an arm portion 112 with a pivoting proximal end 50. The arm 112 may be formed integrally with the trigger 110 or, alternatively, coupled to the trigger 110 via any number of methods known in the art, such as welding, adhesives, mechanical interlocking, etc.

Rotation or movement of the trigger 110 may be defined by one or more movement limiting features disposed along a length thereof. For example, the trigger 110 may include a stopper 114 projecting from a proximal end of the trigger 110. A length of the stopper 114 may vary depending on a size of the trigger 110. In a neutral position, the stopper 114 may be separated from a stop guard 116, which extends from a base of the trigger arrangement 100 and prevents further rotation of the trigger. As the trigger 110 is rotated through a range of movement, the stopper 114 eventually encounters the stop guard 116 and the trigger 110 is prevented from further rotation and/or movement. Thus, the distance between the stopper 114 and the stop guard 116 may define the range of trigger movement. The stopper 114 and the stop guard 116 may be formed of any substantially rigid material, but may not necessarily be of the same material. Those skilled in the art will understand that the stopper/stop guard arrangement described above is purely exemplary and other mechanisms for limiting trigger movement may be implemented in other embodiments.

The trigger arrangement 100 may further include a switching bracket 210 that includes an angled portion 212 terminating in a switching head 22. The switching bracket 210 may rotate about a hinge 60 that enables the switching bracket 210 to rotate between a locked position 33 and a triggering position 35. The switching bracket 210 may be mechanically coupled to the trigger arm 112 such that rotation of the trigger 110 causes the switching bracket 210 to rotate between the locked and triggering positions 33, 35. For example, the distal end 50 may push against the switching bracket 210 with a force sufficient to bring the switching bracket 210 into the triggering position 35.

The switching head 22 may include a magnet 20 that activates a switch 90. In one exemplary embodiment, the switch 90 may be a reed switch that is activated when the magnet 20 is brought into proximity to the switch 90 (e.g., when the switching bracket 210 is in the triggering position 35). If the switch 90 is a normally open switch, a magnetic field exerted by the magnet 20 upon the switch 90 may cause switching components within the switch 90 to come into contact with each other, placing the switch 90 into a closed position. Alternatively, if the switch 90 is a normally closed switch, the magnet 20 may cause the switching components to separate, placing the switch 90 into an open position.

The switching head 22 may also include a stop ridge 24 extending from an end thereof. The stop ridge 24 may define the triggering position 35 by contacting a sidewall 26 that extends from the base of the trigger arrangement 100. When the stop ridge 24 contacts the sidewall 26, the switching head 22 may no longer be able to move further away from the locked position 33 and comes to a stop at the triggering position 35.

The switching bracket 210 may be returned to the locked configuration 33 from the triggering position 35 by a spring (e.g., a coil spring) disposed within the hinge 60. The coil spring may be biased towards the locked position 33, resisting movement of the switching bracket 210 towards the triggering position 35. The coil spring may provide a constant rate of triggering resistance (e.g., as a function of a spring constant and a displacement of the spring) that can be tactilely sensed by the user as a perceived resistance against a triggering motion (e.g., trigger rotation). The perceived resistance may be felt as a steadily increasing force that reaches a maximum when the triggering position 35 is reached. Because the resistance is steady and continuous, the coil spring may not provide any feedback to confirm that the trigger arrangement 100 has been successfully activated. As will be described in detail below, the exemplary embodiments of the present invention provide a feedback mechanism by which the user may be provided with feedback that indicates the trigger 110 has been activated. This feedback may comprise a sudden change in a force with which the trigger arrangement 100 resists the triggering motion. This change may translate to a "clicking" sensation that can be felt by the user via the trigger 110.

Those skilled in the art will understand that any type of switch may be utilized as the switch 90. For example, in another embodiment, the switch 90 may be a contact switch activated by physical contact with the switching head 22. In yet another embodiment, the switch 90 may be a vibration sensitive switch that reacts to vibrations caused when the switching bracket 210 enters the triggering position 35 from the locked position 33. Thus, in some embodiments, the magnet 20 may not perform any switching functions. However, as will be described below, the magnet 20 may, nevertheless, perform a feedback function. This may be true regardless of whether the magnet 20 induces opening and/or closing of the switch 90.

The switch 90 may be mounted on a circuit board 15 or substrate of the handheld device. Activation (e.g., opening or closing) of the switch 90 may enable a functionality of the handheld device (e.g., enabling a bar code scanning arrangement). The circuit board 15 may comprise any number of electronic components such as a microcontroller or processor, a memory, signal processing components, etc. The switch 90 may be directly coupled to one or more of the circuit board components. Alternatively, output from the switch 90 may be indirectly coupled to the circuit board components, along with output from additional switches and/or other input signals, via a signal bus or an intermediate component such as a buffer.

In addition to providing a mechanism by which the switch 90 may be activated, the trigger arrangement 100 may enable a feedback response in the form of a tactile "click" that can be felt by the user when the switching bracket 210 moves from the locked position 33 to the triggering position 35. As discussed above, the feedback response may be a function of the magnet 20, which acts upon an iron object (e.g., an iron stud 80) located proximal to the magnet 90 when the switching bracket 210 is in the locked position 33. The magnet 20 attracts the iron stud 80, which is secured to the base of the triggering arrangement 100, proximal of the switching head 22. Because the iron stud 80 may be situated away from the triggering position 35, a force of magnetic attraction between the magnet 20 and the iron stud 80 resists triggering. The user must exert enough force against the trigger 110 to disengage the switching bracket 210 from the locked position 33. Once the exerted force is sufficient to causing disengaging, the switching bracket 210 is suddenly released from magnetic holding, which results in a clicking sensation that comprises the feedback response. Neither the magnet 20 nor the switching head 22 need be in actual contact with the iron stud 80 in order to achieve the feedback response. That is, it may be sufficient that the magnet 20 act upon the iron stud 80 at a distance.

The magnetic force between the magnet 20 and the iron stud 80 may determine a snap ratio for the trigger arrangement 100. The snap ratio may be defined as an equation (F1−F2)/F1, where F1 is an actuation force and F2 is a contact force. The actuation force F1 represents an amount of force that must be exerted by the user on the trigger 110 in order to bring the switching bracket 210 from the locked position 33 to the triggering position 35. This may be a function of the magnetic force and/or a force exerted by the trigger arm 112 on the switching bracket 210. The contact force F2 represents an amount of force required to maintain the switching bracket 210 in the triggering position 35. That is, the user must exert a minimum force (F2) in order to maintain the stop ridge 24 in contact against the sidewall 26. Otherwise, the coil spring in the hinge 60 may return the switching arm 210 to the locked position 33. A high snap ratio (e.g., a small F2 relative to F1) may indicate a more forceful feedback response.

The snap ratio may be adjusted to achieve a desired level of feedback by varying any number of parameters of the triggering arrangement 100. For example, if a higher actuation force F1 is desired, a stronger magnet 20 may be used. A material from which the stud 80 is made may also be changed depending on the desired feedback level. For example, a higher actuation force F1 may correspond to use of a ferromagnetic material or ferromagnetic alloy (e.g., iron, nickel, cobalt, etc.), which exhibits a strong attraction to magnetic forces exerted thereupon by the magnet 20. If a lower actuation force F1 is desired, a paramagnetic material (e.g., aluminum) and/or a weaker magnet 90 may be used. Other feedback parameters may include, for example, a distance between the magnet 20 and the stud 80, a geometry of the magnet 20 and/or the stud 80, a strength of the coil spring, etc.

The exemplary embodiments of the present invention enable a feedback response in situations in which achieving feedback using conventional trigger arrangements would be difficult or impossible. The trigger arrangement 100 has minimal space and hardware requirements. Furthermore, the teachings of the present invention may be implemented in conventional trigger arrangements without interfering with existing functionalities of the conventional arrangements, such as existing trigger mechanisms. The exemplary embodiments of the present invention may be implemented in applications where there is limited space to implement conventional feedback mechanisms, or where it is too expensive to do so.

In addition, the trigger arrangement 100 is able to confirm that it has been activated successfully. This may be useful in situations where the user cannot visually or audibly confirm trigger activation. The user may also derive a psychological benefit from feeling the clicking of the trigger arrangement 100, since clicking is often associated with a high quality product (e.g., in terms of reliability, build quality, durability, etc.).

The exemplary embodiments of the present invention also allow the ability to adjust a level of feedback. By varying trigger parameters, a high snap ratio may be achieved in applications where more feedback is desired. If less feedback is required, the trigger arrangement 100 may be designed with a lower snap ratio. Thus, different trigger arrangements may be utilized depending on a particular application.

The present invention has been described with reference to the above exemplary embodiments. One skilled in the art would understand that the present invention may also be successfully implemented if modified. Accordingly, various modifications and changes may be made to the embodiments without departing from the broadest spirit and scope of the present invention as set forth in the claims that follow. The specification and drawings, accordingly, should be regarded in an illustrative rather than restrictive sense.

What is claimed is:

1. A device, comprising:

a trigger arrangement activating a function of the device, the trigger arrangement including a trigger mechanism movable between a first position and a second position; and a feedback mechanism comprising a magnet exerting a magnetic force on a fixed object thereby biasing the trigger mechanism to the first position, the feedback mechanism producing a tactile feedback response when the trigger mechanism is moved from the first position to the second position, wherein the magnet never physically contacts the fixed object.

2. The device according to claim 1 wherein the magnet acts on the fixed object from a distance when the trigger mechanism is in the first and the second positions.

3. The device according to claim 1, wherein the fixed object is formed of one of a ferromagnetic material and a paramagnetic material.

4. The device according to claim 1, wherein the magnet is closer to the fixed object when the trigger mechanism is in the first position.

5. The device according to claim 1, wherein the trigger mechanism activates a switch when in the second position.

6. The device according to claim 5, wherein the switch is one of a reed switch and a contact switch.

7. The device according to claim 5, wherein the switch activates the device function.

8. The device according to claim 1, wherein the tactile feedback response is a clicking sensation.

9. The device according to claim 1, wherein the tactile feedback response occurs immediately after the trigger mechanism is moved away from the first position.

10. The device according to claim 1, wherein a magnitude of the tactile feedback response is a function of a force required to move the trigger mechanism from the first position to the second position.

11. The device according to claim 1, wherein a magnitude of the tactile feedback response is a function of a force required to maintain the trigger mechanism in the second position.

12. The device according to claim 1, wherein the trigger mechanism is a manually operated trigger.

13. The device according to claim 1, further comprising a return mechanism returning the trigger mechanism to the first position.

14. The device according to claim 13, wherein the return mechanism is a coiled spring.

15. The device according to claim 1, wherein the second position is defined by a mechanical interface including a portion of the trigger mechanism.

16. The device according to claim 1, wherein the device function is a data acquisition function including one of a bar code scanning function and an RFID reading function.

17. A trigger arrangement, comprising:

a trigger;

a switching bracket coupled to the trigger, the switching bracket being movable from a first position to a second position corresponding to movement of the trigger; and a magnet coupled to the switching bracket, the magnet being magnetically coupled to a ferromagnetic object when the switching bracket is in the first position, a tactile feedback being provided to a user operating the trigger based on a force needed to overcome the magnetic coupling of the magnet to the object to move the switching bracket from the first position to the second position, wherein the magnet never physically contacts the ferromagnetic object.

18. A device, comprising:

a trigger means activating a function of the device, the trigger means including a trigger mechanism movable between a first position and a second position; and a feedback means comprising a magnet exerting a magnetic force on a fixed object thereby biasing the trigger mechanism towards the first position, the feedback means producing a tactile feedback response when the trigger mechanism is moved from the first position to the second position, wherein the magnet never physically contacts the fixed object.

* * * * *